United States Patent [19]

Watanabe et al.

[11] 3,943,847

[45] Mar. 16, 1976

[54] HIGH SPEED PRINTING APPARATUS

[75] Inventors: Akinori Watanabe; Katsuhide Tanoshima, both of Tokyo, Japan

[73] Assignee: Oki Electric Industry Co., Ltd., Tokyo, Japan

[22] Filed: Aug. 7, 1974

[21] Appl. No.: 495,378

[52] U.S. Cl. ..... 101/114; 101/DIG. 13; 355/3 R

[51] Int. Cl.[2] ..... G03G 13/06

[58] Field of Search ..... 101/114, DIG. 13, 1; 355/3 R

[56] References Cited

UNITED STATES PATENTS

| | | | |
|---|---|---|---|
| 3,017,234 | 1/1962 | Trimble | 101/DIG. 13 UX |
| 3,370,529 | 2/1968 | Michalchik | 101/DIG. 13 UX |
| 3,779,166 | 12/1973 | Pressman | 101/DIG. 13 X |

FOREIGN PATENTS OR APPLICATIONS

| | | | |
|---|---|---|---|
| 526,892 | 2/1952 | United Kingdom | 101/DIG. 13 |

*Primary Examiner*—Harland S. Skogquist
*Attorney, Agent, or Firm*—Peter L. Berger

[57] ABSTRACT

In a high speed printing apparatus of the type in which ions produced between electrodes carrying a high voltage are passed through a mist of ink to cause selective particles of the ink to effect printing, there is provided an air circulating system in which the air containing the mists of ink is recovered, treated and again transferred to the printing portion.

9 Claims, 2 Drawing Figures

HIGH SPEED PRINTING APPARATUS

BACKGROUND OF THE INVENTION

Increasing demand for high speed operation of central processing units of electronic computers causes need for high speed processing output devices, i.e. high speed printing apparatus.

In one of the typical types of printing apparatus, there is a printing system in which ink is supplied to the nozzle under a slight pressure so that the ink forms as a hemispherical shape at the tip of the nozzle, and the ink is drawn in droplet form by applying an electric field between an accelerating electrode positioned a few milimeters ahead of the nozzle and the nozzle, and droplets of ink are moved toward the surface of the recording paper by applying a high electric field between the nozzle and platen. The droplets of ink are electrostatically deflected in both directions (right and left) to print characters or symbols on the surface of the recording paper.

Another typical printing apparatus is one in which ions produced between electrodes carrying high voltage are passed through mists of ink and the particles of ink are selectively adhered to the surface of the recording paper to obtain printing. The present invention relates to this type of printing apparatus.

The printing system will be described in detail. The ionization of the air is carried out by utilizing corona discharge. Application of a few thousand volts to a very thin conductor cause a corona discharge to occur, and molecules such as oxygen, nitrogen or the like in the air surrounding this conductor are ionized. The ions produced around this conductor are attracted to the platen side by the electric field existing between the back of the recording paper and the platen.

The ink of this system are agitated by supersonic waves, changed into a mist having drops with diameters of 5 to 20 $\mu$ and suspended in the air. This mist is fed between the platen and a source of corona discharge by pneumatic pressure in the same direction as that of the feeding paper and at approximately the same speed as that of the feeding paper. Thus, said ions are passed into the mist of ink, adhered around the mist, moved in the combined directions of electrostatic force and the force of the flow of the mist, and adher recording paper positioned between the platens.

The general configuration of the type of apparatus used is shown in the block diagram of FIG. 1, and comprises two parts, a main body 11 and a control part 12. The main body 11 has a paper feeding device 13, a printing part 14, a mist generating part 15, an ink circulating device 16 and a mist treatment device 17, and the control part 12 has a control circuit 18 and a driving circuit 19 for the mist generating device.

Thus, in the above-mentioned type of high-speed printing device, ink mists being fed in front of the recording paper are recovered and fed to the condensor, therein separated to the ink solution and the air, and the air is discharged outside the apparatus. However, this air has a smell produced by the solvent of the ink and cause the operator discomfort.

It is an object of the present invention to provide a system in which the separated air is again fed to the printing part and circulated, and is prevented from being leaked outside the apparatus, as little as possible.

SUMMARY OF THE INVENTION

In the present invention, mists of ink are collected with the printing part being substantially sealed, said mists of ink being separated into air and ink portions. The separated air is transferred to the mist tank in which the ink is changed into a mist condition for converting the air into the ink mist, while the air is utilized for a directional air stream for transferring the mists of ink generated from the mist tank to the recording paper.

DETAILED DESCRIPTION OF THE PREFERRED EMBODIMENT

Figure 1:
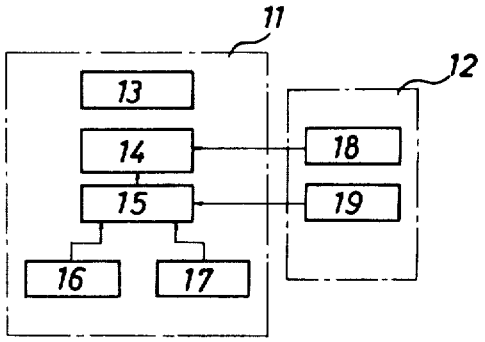
FIG. 1 is a diagramatic view showing the type of apparatus on which the present invention may be used.
Figure 2:
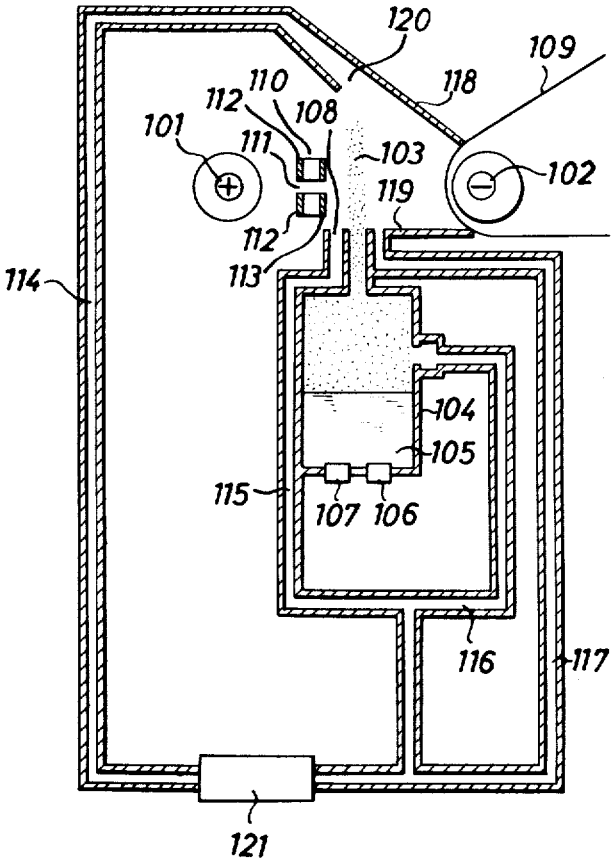
FIG. 2 is a view showing the circulating system for the air which forms the present invention.

High voltage is applied between the anode 101 and cathode 102 and a stream of ink mist layer 103 is generated therebetween. The stream of ink mist layer 103 is generated by the ink solution 105 in the mist tank 104 being vibrated by the vibrating members 106 and 107 comprising piezoresonators, and the layer 103 is transferred to the front of the recording paper 109 by air discharged from a discharge port 108 for the air. Aperture plate 110 mounted in front of the anode 101 comprises a through hole 111, control electrode 112 and common electrode 113, and said through hole 111 and control electrode 112 are opposed by one another in the row direction of the recording paper 109, arranged in a plurality of numbers to control the transfer of ions. Reference numbers 114, 115, 116 and 117 are passages for feeding air in this system, all designated generally as an air recirculating system.

Describing the printing operation in brief, in accordance with the printing pattern made by a character register (not shown), control electrodes 112 of the aperture plate 110 are set to a predetermined voltage. Ions produced proximate of the anode 101 move towards the cathode 102, and some of the ions are obstructed by the aperture plate 110 and some of them pass into the stream of ink mist 103 through the aperture 111. At this time, ions attached with particles of ink move toward cathode 102 and are adsorbed on the recording paper 109 and the dots are printed thereon. Desired characters are printed by the dots by making the ions as the main scan and the feed of the recording paper 109 as the sub-scan.

Operations of the above-described configuration will now be described.

At first, the air is fed into the mist tank 104 from passage 116, the stream of ink mist layer 103 is fed between the aperture plate 110 and cathode 102 as well as to the front surface of the aperture plate 110 through the passage 115 and prevents the particles of ink from adhering to the through hole thereof. Further, the air is fed through the passage 116 in such a manner that the portions other than the printed portion of the recording paper 109 are not soiled. One wall 118 of the passageway 114 and the opposite wall 119 of the passage 117 are respectively in contact with the recording paper 109 and keep the printing portion in an approximately closed or sealed condition.

The mists of ink are recovered from opening 120 through passage 114 and transferred to a condensor 121 where the mists are liquified and separated into an ink solution portion and an air portion, the air being further transferred to the printing part through the passageways 115, 116 and 117.

As described above, the present invention is provided with circulating paths in which each time the air containing the mists of ink is treated the same air is again transferred to the printing part, and since the air containing the ink mists is not fed to the outside of the apparatus, the smell of the ink is prevented from leaking out of the apparatus.

What we claim is:

1. An air recirculating system for a high speed printing apparatus in which ionized particles are mixed with an air-ink mist to cause printing on a platen, said air-ink mist being formed by vibrating a tank containing said ink, said printing apparatus comprising an anode, a cathode, with said mist being passed therebetween, recording paper for receiving ink to be deposited thereon, an aperture plate and control electrode located between said anode and said ink mist to control the deposition of ink on said recording paper, wherein the improvement comprises passage means for forming air streams between said ink mist and said aperture and control plates and between said ink mist and said recording paper, respectively for preventing soiling of said aperture and control plates, said air recirculating system comprising means to recover the air ink mist after it passes said platen, means for separating said air from said ink, and conduit means for carrying said separated air to the tank for forming said air-ink mist.

2. An air recirculating system for a high speed printing apparatus as set forth in claim 1, wherein said means for separating said air from said ink comprises a condensor.

3. An air recirculating system as set forth in claim 1, wherein said passage means comprises a pair of spaced apart passageways located on opposite sides of said ink-mist for carrying said ink-mist past said platen.

4. An air recirculating system as set forth in claim 3, further comprising a second passageway connected between said conduit means and said tank for carrying said ink-mist out of said tank.

5. An air recirculating system as set forth in claim 4, wherein said spaced-apart passageways and said second passageway are connected together and to said conduit means.

6. An air recirculating system for a high speed printing apparatus as set forth in claim 5, wherein said conduit means comprises directional control means for causing the air-ink mist generated in said tank to be transferred to the platen.

7. An air recirculating system for a high speed printing apparatus as set forth in claim 5, wherein said recirculating system comprises means for sealing the air-ink mist within the printing apparatus.

8. An air recirculating system for a high speed printing apparatus as set forth in claim 7, wherein said means for sealing comprises a wall section contacting the upper portion of said platen and another wall section contacting the lower portion of said platen, the printing occurring on said platen portion between said upper and lower portions, said platen portion facing said air-ink mist.

9. An air recirculating system for a high speed printing apparatus as set forth in claim 8, wherein said means to recover the air-ink mist comprises a conduit formed at least in part by said wall section contacting said upper portion of said platen.

* * * * *